US005094454A

United States Patent [19]

Schering

[11] Patent Number: 5,094,454

[45] Date of Patent: Mar. 10, 1992

[54] NOVELTY GOLF CLUB

[76] Inventor: Jeff J. Schering, 19444 Plumwood Ct., Brownstown, Mich. 48183

[21] Appl. No.: 606,494

[22] Filed: Oct. 31, 1990

[51] Int. Cl.[5] ..... A63B 53/00; A63B 53/12

[52] U.S. Cl. ..... 273/80 B; 273/80 R; 273/80.3; 273/80.6; 272/8 N

[58] Field of Search ..... 273/80 R, 80 B, 77 R, 273/167 R; 446/374; 272/8 N

[56] References Cited

U.S. PATENT DOCUMENTS

| | | | |
|---|---|---|---|
| 1,615,232 | 1/1927 | Pryde et al. | 273/80 R |
| 3,432,326 | 3/1969 | Lemelson | 273/80 R |
| 3,809,403 | 5/1974 | Hunter | 273/80 B |
| 3,834,700 | 9/1974 | Averbach | 273/80 R |
| 4,326,716 | 4/1982 | La Coste | 273/167 R |
| 4,936,582 | 6/1990 | Bernstein | 273/80 B |
| 4,982,963 | 1/1991 | Fazio et al. | 273/80 B |

OTHER PUBLICATIONS

The Sporting Goods Dealer, Garrison Wagner Co., Jul. 1980, p. 176.

*Primary Examiner*—Edward M. Coven
*Assistant Examiner*—Steven Wong
*Attorney, Agent, or Firm*—Lynn E. Cargill

[57] ABSTRACT

This invention discloses a novelty golf club having a bendable shaft made of a special, non-tempered aluminum with a plastic sheath thereabout for allowing hot tempered golfers to take out their frustrations on a golf club. The golf club can remain bent and placed in the golf bag as a joke or novelty.

4 Claims, 1 Drawing Sheet

NOVELTY GOLF CLUB

TECHNICAL FIELD

This invention pertains to golf clubs, and particularly to a bendable novelty golf club.

BACKGROUND OF THE INVENTION

Golfing has long been known to be a frustrating sport. Golfers who do not perform well on the golf course find consternation and frustration pent up inside. Previously, other novelty items have been used to vent the frustration of the frustrated golfer. Golfers have been known to destroy expensive golf clubs in an attempt to relieve themselves of tension.

It would be advantageous to provide a device for a frustrated golfer to vent his frustrations. It would be especially advantageous to have a golf club which would be bendable such that the golfer could smash the golf club against a tree or an opponent without hurting the golf club. In the past, certain bendable golf clubs have been produced for practicing swinging and use of flexible or limber shafts in order to simulate a heavy swing so that such a club may be used inside. Many attempts have been made to increase the flexibility of golf club shafts, and there are several important properties or characteristics which must be present in a properly designed shaft for practice swings.

However, the same considerations would not be applicable to the instant problem of a bendable golf club shaft because the practice clubs contain memory materials to bring the club back to its original position.

One attempt to produce a bendable memory material in a golf club shaft is disclosed in U.S. Pat. No. 4,936,582 issued to Kenneth Bernstein on June 26, 1990 which discloses a golf club molded in a single piece including a grip, shaft and head, preferably in the form of a putter or a wedge employing a flexible plastic shaft with a convention grip and club head. The material for the molded club or shaft is either polyurethane of 70 durometer; Shore D Rating or natural rubber of 70 durometer Shore A Rating, each with 2,000 psi tensile strength.

Although the above-described patent discloses a rubber or plastic golf club, the club does not have a naturally simulated appearance to a regular golf club. Especially since it is a molded one-piece club, it is apparent to anyone that it is a fake club.

Therefore, it is the primary object of the present invention to provide a normal, simulated golf club which is bendable, has a memory capacity, and may be bent to vent frustrations and then unbent when it is desired to return it to its original shape.

SUMMARY OF THE INVENTION

In accordance with the preferred embodiment of the invention, these and other objects and advantages are addressed as follows. A golf club is disclosed which is capable of bending easily at the shaft when struck against an object, and is further capable of being manually straightened. The club can be used to vent the frustrations of a golfer without resorting to damaging valuable clubs or causing injury to himself or others. The club has a grip, shaft, and head like an ordinary golf club, however, the shaft is made of a non-heat treatable alloy aluminum tube giving the shaft the ability to deform easily. When the club is struck against a hard object it deforms readily around the object and remains in this deformed state instead of springing back straight, thereby behaving as an ordinary golf club if so mistreated. Unlike an ordinary golf club, however, the shaft of the present invention can easily be manually straightened and re-used. The aluminum tube is surrounded by a plastic tube which protects the aluminum tube from cuts and scratches. The plastic tube is preferably clear, allowing the aluminum finish underneath to be seen through the plastic giving the club a realistic appearance without having to paint or otherwise modify the surface of the shaft in order to simulate the appearance of an ordinary golf club.

BRIEF DESCRIPTION OF THE DRAWINGS

The nature and extent of the present invention will be clear from the following detailed description of the particular embodiments thereof, taken in conjunction with the appendant drawings, in which.

DETAILED DESCRIPTION OF THE INVENTION

Figure 1:
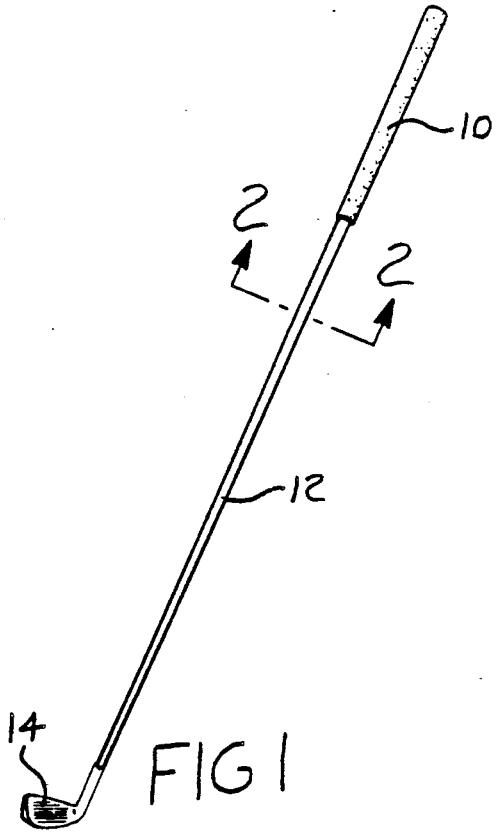
FIG. 1 generally depicts the inventive device constructed in accordance with the present invention, wherein the shaft is straight.

Referring first to FIG. 1, the golf club of the present invention is generally depicted in its straightened, non-deformed condition. A grip 10 is affixed to the top of a shaft 12, while a head 14 is affixed to the bottom of shaft 12. The function of a grip on a traditional golf club, as well as on the present invention, is to provide a place for one to securely and comfortably hold the club while it is swung. In the preferred embodiment, the handle is made of a seamless blended natural rubber with a EPTDM 55 durometer.

The head is mostly ornamental, yet it needs to be resilient enough to resist damage which could result from the head striking a hard object. In the preferred embodiment of the invention, the head is made of a plastic material, Formion F1 120-01 natural, available from A. Schulman Co. of Michigan. The head can be made into the shape of any type of traditional golf club head including a putter, word or driver, iron, or wedge.

Figure 2:
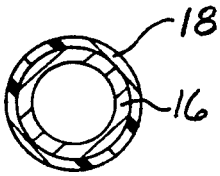
FIG. 2 is a section taken along line 2—2 of FIG. 1.

Referring next to FIG. 2, a section of shaft 12 taken along line 2—2 in FIG. 1 can be viewed. A tube preferably made of a soft, non-treatable alloy aluminum alloy 16 occupies the innermost portion of shaft 12 while a tube of a soft plastic material 18 surrounds, and is in contact with, aluminum tube 16. The contact between aluminum tube 16 and plastic tube 18 does not need to be a strong bond as the invention will still function properly if these two tubes are allowed to slip alongside one another. Preferably, the plastic tube 18 is a dimension which can easily be slipped onto aluminum tube 16 for ease of manufacturing.

Figure 4:
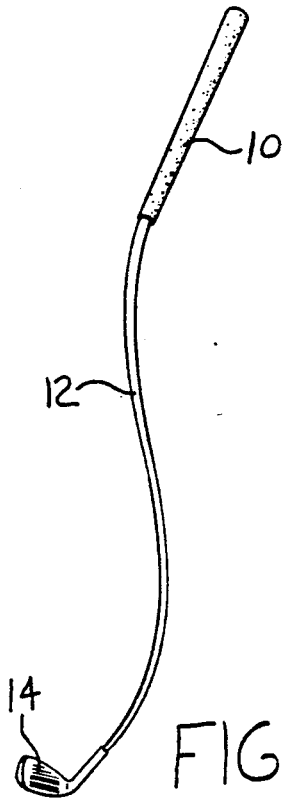
FIG. 4 generally depicts the inventive device of FIG. 1 as it might appear after being struck against an object and deformed.
Figure 3:
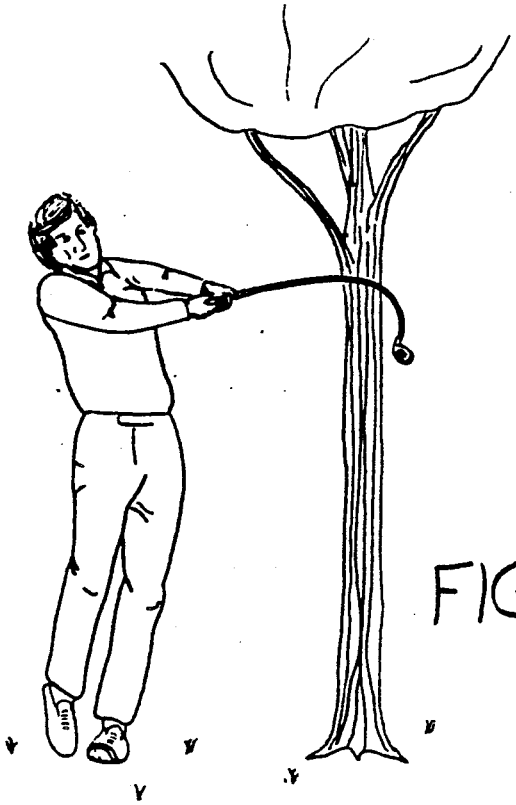
FIG. 3 illustrates a frustrated golfer striking a tree trunk with the invention so as to deform the shaft of the invention.

As depicted in FIGS. 3 and 4, the shaft 12, being made of soft aluminum, is capable of deforming easily with minimal force. In the preferred embodiment of the present invention, the aluminum tube is made of a non-heat treatable alloy that is bar rolled or cold finished. Further, it has 1100-0 tensile strength, 11 minimum to 15.5, with a maximum yield, 3.0 minimum, and 99% elongation of 25.1. Also, in the preferred embodiment of the present invention, the plastic tube 18 is made of polyvinyl chloride with a durometer shore value of A67, an inside diameter of 5/16 inches, and a wall thickness of about 1/16 inch. Other suitable materials include thermoplastics, urethane and nylon.

Other materials will work well in the grip, shaft, and head, of the present invention. For instance, the head can be made of almost any kind of substantially non-deforming plastic. The head could also be made of a plastic or rubber, either synthetic or natural, or it could even be made of foam rubber. Whichever material is used for the head, softer materials are preferred to avoid any possible injury to people or damage to objects. For the shaft, the aluminum tube is preferably made of a non heat treatable aluminum alloy, but any type of soft aluminum is acceptable. The advantage to aluminum is that it is light, which makes it safer to swing around, and aluminum is commercially available in soft grades which makes it easy to deform. The plastic tube can be made of almost any type of commercially available soft plastic or it could be a clear or opaque rubber tube. Clear plastic is preferable, however, because it allows the aluminum finish to show through and gives the appearance of an ordinary golf club with a metal shaft.

Also envisioned are variously sized clubs for children, and even smaller ones for desk-top use or as an executive desk toy. The invention shall encompass any size being manufactured.

Thus, there is provided in accordance with the present invention, a golf club with a deformable shaft, capable of being struck against an object with the shaft deforming upon striking the object. The shaft is made of a tube of soft aluminum surrounded by a tube of plastic which services to protect the aluminum. The golf club has a grip similar to a traditional golf club and a head that is made of a non-deformable plastic or rubber material and is in the shape of a traditional golf club head. The present invention can be used by a frustrated golfer to vent his frustrations without damaging valuable golf clubs. The golf club can then be straightened manually so that it can be used repeatedly.

While my invention has been described in terms of a specific embodiment, it will be appreciated that other embodiments could readily be adapted by one skilled in the art. Accordingly, the scope of my invention is to be limited only by the following claims.

I claim:

1. A novelty golf club comprising a grip, a shaft, a plastic tube surrounding said shaft, and a head, said shaft comprising an aluminum tube made from a soft non-heat treatable aluminum alloy, said aluminum tube being in contact with the surrounding plastic tube, and said shaft being capable of deforming easily so that when the club is swung against an object the shaft will bend and stay bent until manually straightened.

2. The golf club of claim 1, wherein said head is made from a material selected from the group consisting of natural rubber, synthetic rubber, foam rubber and plastic.

3. The golf club of claim 1, wherein said non-heat treatable alloy aluminum tube is 1100-0 tensile, 11 minimum to 15.5 maximum yield, 3.0 minimum, 99.00% elongation 25.

4. The golf club of claim 1, wherein said surrounding plastic tube is made from a material selected from the group consisting of polyvinyl chloride, thermoplastics, urethane, and nylon.

* * * * *